US006681958B2

(12) United States Patent
Sorenson et al.

(10) Patent No.: US 6,681,958 B2
(45) Date of Patent: Jan. 27, 2004

(54) SUPPLEMENT COMPARTMENT FOR BEVERAGE CONTAINER

(76) Inventors: Joseph T. Sorenson, 5741 Ridge Creek Rd., Salt Lake City, UT (US) 84107; Dan J. Walton, 5760 Surreyrun Rd., Murray, UT (US) 84107

( * ) Notice: Subject to any disclaimer, the term of this patent is extended or adjusted under 35 U.S.C. 154(b) by 0 days.

(21) Appl. No.: 09/908,214

(22) Filed: Jul. 18, 2001

(65) Prior Publication Data

US 2002/0008116 A1 Jan. 24, 2002

Related U.S. Application Data

(60) Provisional application No. 60/219,219, filed on Jul. 18, 2000.

(51) Int. Cl.[7] ..... B67D 5/60

(52) U.S. Cl. ..... 222/145.1; 222/131; 215/6; 215/11.1

(58) Field of Search ..... 222/1, 145.31, 222/522, 131; 215/6, 11.1, 11.6, 227; 426/115

(56) References Cited

U.S. PATENT DOCUMENTS 2,766,796 A * 10/1956 Tupper ..... 220/521
4,614,267 A * 9/1986 Larkin ..... 206/219
4,648,529 A * 3/1987 Blakemore et al. ..... 210/803
4,793,475 A * 12/1988 Itzel ..... 206/219
5,361,918 A * 11/1994 Mason ..... 215/6
5,465,835 A * 11/1995 Schumacher et al. ..... 206/219
D390,964 S * 2/1998 Mercer et al. ..... D24/197
5,914,116 A * 6/1999 Suares et al. ..... 424/401
6,116,439 A * 9/2000 Yaniv ..... 215/11.1
6,263,923 B1 * 7/2001 Castillo ..... 141/100
6,472,007 B2 * 10/2002 Bezek et al. ..... 426/115

* cited by examiner

*Primary Examiner*—Gene Mancene
*Assistant Examiner*—M A Cartagena
(74) *Attorney, Agent, or Firm*—TraskBritt

(57) ABSTRACT

An apparatus and method for associating a supplement compartment with a liquid container, wherein the supplement may be a vitamin, mineral, analgesic, antibiotic or other medicine, flavor or color additive or nutritional in nature, and may be readily accessible and retrievable for use with the liquid such as water or other beverage. The compartment may be nested atop a cap that covers the dispenser of the container or may be otherwise associated with the container in a secure but temporary and accessible manner.

18 Claims, 10 Drawing Sheets

SUPPLEMENT COMPARTMENT FOR BEVERAGE CONTAINER

CLAIM OF PRIORITY

Pursuant to the provisions of 35 U. S.C. 119(e), this application claims the benefit of the filing date of provisional patent application Ser. No. 60/219,219, filed Jul. 18, 2000, for "SUPPLEMENTAL COMPARTMENT FOR BEVERAGE CONTAINER."

BACKGROUND OF THE INVENTION

1. Field of the Invention

This invention relates to beverage containing and dispensing systems. It is particularly directed to a compartment that may be associated with a liquid container and that is to contain supplements for ingestion with water and other beverages.

2. State of the Art

Beverage container and dispenser systems associated with compartments have heretofore involved various features.

For example, chambers for mixing to achieve carbonation are disclosed in U.S. Pat. No. 4,466,342, "Carbonation Chamber with Sparger for Beverage Carbonation" and U.S. Pat. No. 4,458,584, "Beverage Carbonation Device." Other systems pertaining to compartments further include structure for osmotic mixing such as, for example, those disclosed in U.S. Pat. No. 5,340,590, "Delivery System With Bilayer Osmotic Engine"; U.S. Pat. No. 5,223,265, "Osmotic Device With Delayed Activation of Drug Delivery"; and U.S. Pat. No. 5,312,390 "Osmotic Device With Delayed Activation of Drug Delivery."

Snap-on caps and over caps such as those disclosed respectively in U.S. Pat. Nos. 5,472,121 and 5,813,575, though better suited for their intended nozzle protection may be regarded as compartment structure. A dispenser capable of delivering a plurality of drug units is disclosed in U.S. Pat. No. 5,391,381 and involves a compartment aspect, but is directed toward delivery of a plurality of discrete drug-containing units in a pattern or profile.

Nested vial and ampule designs are disclosed respectively in U.S. Pat. Nos. D325,340 and D325,341. The nesting structure forms compartments.

Heretofore, to enjoy the benefit of ingesting any vitamin, mineral, flavoring, nutrient, analgesic or other medicinal supplement or the like along with a beverage, such as water, it has been necessary to separately plan for and transport such supplement. Consequently, supplements that have been misplaced or forgotten have, on occasion, been unavailable for their intended use. Where it is important that such a supplement be used on a particular schedule, as is so where certain medicines are involved, this consequence is particularly disadvantageous.

Similarly, where the supplement has been remembered and made available but the beverage has been misplaced, forgotten or is otherwise unavailable, it may be uncomfortable, if not dangerous, to ingest some types of supplements without a beverage readily available to imbibe at essentially the same time. Indeed, some medicines are expressly designed for use concurrent with a liquid.

There is a need for a method of securely but temporarily associating a supplement with a beverage container.

A further need exists for a compartment that is associated with a beverage container and that is susceptible to the facile receiving, storing and dispensing of a supplement, which supplement is to be ingested concurrent or alternatingly with the imbibing of a beverage stored within the container.

There remains a need for a supplement compartment associated with a liquid container wherein the supplement is readily and facilely accessible and retrievable from the compartment for use with the liquid.

There is further yet a need for a supplement compartment whose design enhances efficiency of manufacture and assembly, as well as effectiveness of distribution and use.

BRIEF SUMMARY OF THE INVENTION

The present invention provides an improved compartment affixed to a container, the compartment being structured and arranged to protectively and accessibly enclose a first substance and to enable association of the first substance with a second substance, the second substance being accessibly contained within the container, the association being for substantially combined use with the second substance.

The potential use of the first substance and second substance together may comprise essentially any bodily benefit to a biological organism, which organism may include essentially any vertebrate, in particular mammals and, more particularly, human beings. The first substance may comprise either or any combination of a vitamin, mineral, nutritional or medicinal supplement and, alternatingly or substantially concurrently with the second substance, may be either ingested, imbibed or breathed by, or injected into or topically applied to the biological organism or any portion of its body.

The second substance may include either a solid, or a semi-solid, or a liquid or a gas, but in one presently preferred embodiment comprises a beverage, which may be water.

In one presently preferred embodiment, the invention may comprise a compartment structured and arranged for temporary enclosure and selective disbursement of an edible supplement that is to be ingested substantially at the same time as and with a beverage dispensed from a container with which the compartment is physically associated.

The first substance may comprise either a solid, or a semi-solid, or a liquid or a gas. The solid may comprise a pill, tablet, granule, powder or the like. The semi-solid may comprise a paste, cream, gel, or the like. The liquid may comprise a hydrous or nonhydrous solution.

The present advance in the art may be actualized as a method of securely but temporarily associating an ingestible supplement with a liquid container. This method may comprise: providing an ingestible supplement within a compartment; providing a liquid within a container; and physically associating the supplement and compartment with the liquid and container. The cap and container may be physically associated with each other by structuring and arranging the cap to nest atop a dispenser end of the container.

As a part of this method, the compartment may be structured and arranged to be susceptible to the facile receiving, storing and dispensing of the supplement, such that the supplement may be readily accessible and retrievable from the compartment for use with the liquid. The supplement may be ingestible concurrent or alternatingly with the imbibing of the liquid stored within the container.

As a further enhancement to this method, the design of the compartment may be structured and arranged to nest atop a cap of substantially identical form, dimension and material to enhance efficiency of manufacture and assembly, as well as effectiveness of distribution and use.

Accordingly, the present invention may be embodied as a novel bodily refreshment dispensing system which comprises a vitamin, nutritional, mineral or medicinal supplement; a compartment for temporary storage of the supplement; a beverage, comprising water; and a container for temporary accessible storage of the beverage; wherein the compartment is connected to the container atop the container; and wherein the compartment is structured and arranged to accommodate selective access to the supplement stored therein and selective reclosure of the compartment. The access and reclosure may permit the imbibing of the beverage concurrent or alternatingly with the ingestion or imbibing of the supplement.

In summary, a typical embodiment of this invention comprises a bottle, generally of molded plastic, such as the ubiquitous water bottle. The bottle is provided with a suitable cap, which may be either threaded or press fit onto the conventional open top, or spout fixture of the bottle. The cap may be of any conventional or specialized type; typically being adapted for opening to dispense liquid through the cap. Examples of suitable cap structures are those of the "push-pull" or "hinged lid" type. Generally, the dispensing portion of the cap is covered with a removable/replaceable dust cap. According to this invention, the dust cap is enlarged, or otherwise structured, to accommodate a medicament or supplement; e.g., vitamin pills or aspirin. While it is within contemplation to position suitable pills, tablets, capsules, or the like, within an enlarged dust cover cap, it is currently preferred to mount a secondary storage compartment atop the dust cap, ideally in nested arrangement. The secondary compartment may be removed from the dispenser structure of the bottle in association with the dust cover, to permit drinking from the bottle. Alternatively, the secondary compartment may be opened or removed from the dust cap to access the contents of the compartment.

BRIEF DESCRIPTION OF THE SEVERAL VIEWS OF THE DRAWINGS

In the drawings, which illustrate what is currently regarded as the best mode for carrying out the invention.

DETAILED DESCRIPTION OF THE INVENTION

Figure 1:
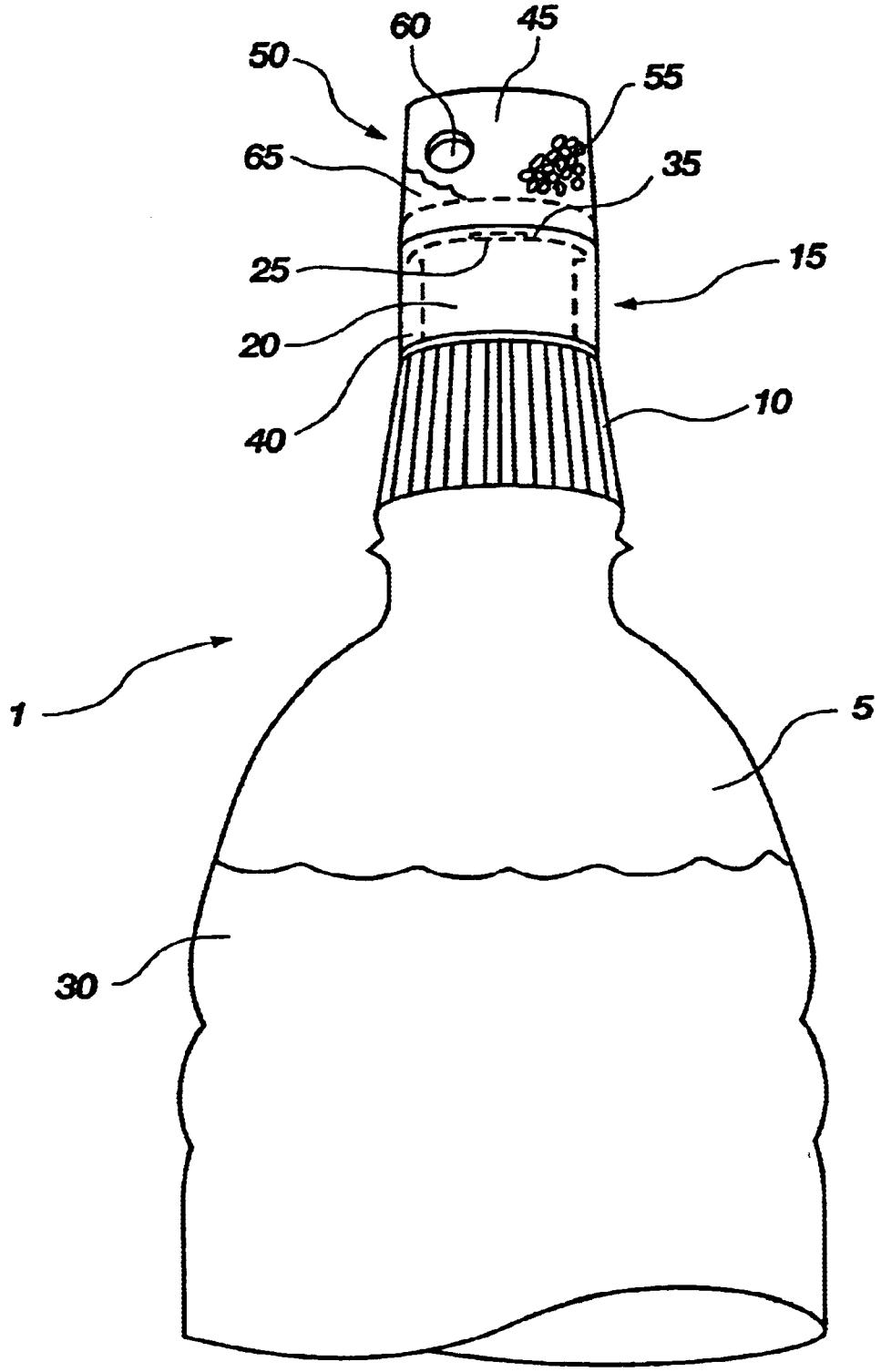
FIG. 1 is a side view of a compartment nested atop a closure which covers a push-pull dispenser of a beverage bottle.

The structural elements of one configuration of the present invention, generally 1, are presented in FIG. 1. As illustrated, a beverage container 5 comprises a closure 10. While closure of containers generally may be accomplished with structure ranging from a simple press-fit, screw-on or hinged cap, cork or lid to a levered spigot or pivoting valve (not shown), the closure 10 of the illustrated configuration includes a standard push-pull spout 15. The spout 15 enables opening of the container 5 by pulling the rim 20 away from the container 5 along a post 25. A liquid 30, which may be water or other beverage, may then be dispensed from the container 5 through a nozzle 35. Closing of the container 5 is accomplished by pushing the rim 20 toward the container 5 along the post 25.

A cap 40 placed atop the closure 10 is commonly used as a form of protection against contamination of the nozzle 35. Closures generally may be further protected against contamination, intentional or otherwise, by such structure as a tamper-proof, shrink-wrap hull (not shown). Upon removal of such a hull, the cap 40 may be selectively removed for actuation of the spout 15 and replaced as a continuing barrier against contamination.

A novel aspect of the present invention includes a compartment 45 associated with the beverage dispensing system 1 that enables temporary storage of a supplement 50 for use in conjunction with the beverage 30. The supplement 50 utilized may be provided in any preferred form such as, for example, a granule or powder 55, a tablet or pill 60, or a paste, liquid or syrup 65. Depending upon the intended benefit sought by use of the supplement 50, the supplement 50 may be applied to the beverage 30 as an additive prior to the beverage being imbibed, such as with flavors, sweeteners or electrolytes. Likewise, the supplement 50 may be ingested and followed by the beverage 30, such as with chewable nutritional supplements. Alternatively, the supplement 50 may be placed in the mouth of a user and the beverage 30 used to facilitate swallowing and dissolution of the supplement 50, such as with aspirin or other medicines.

Figure 2:
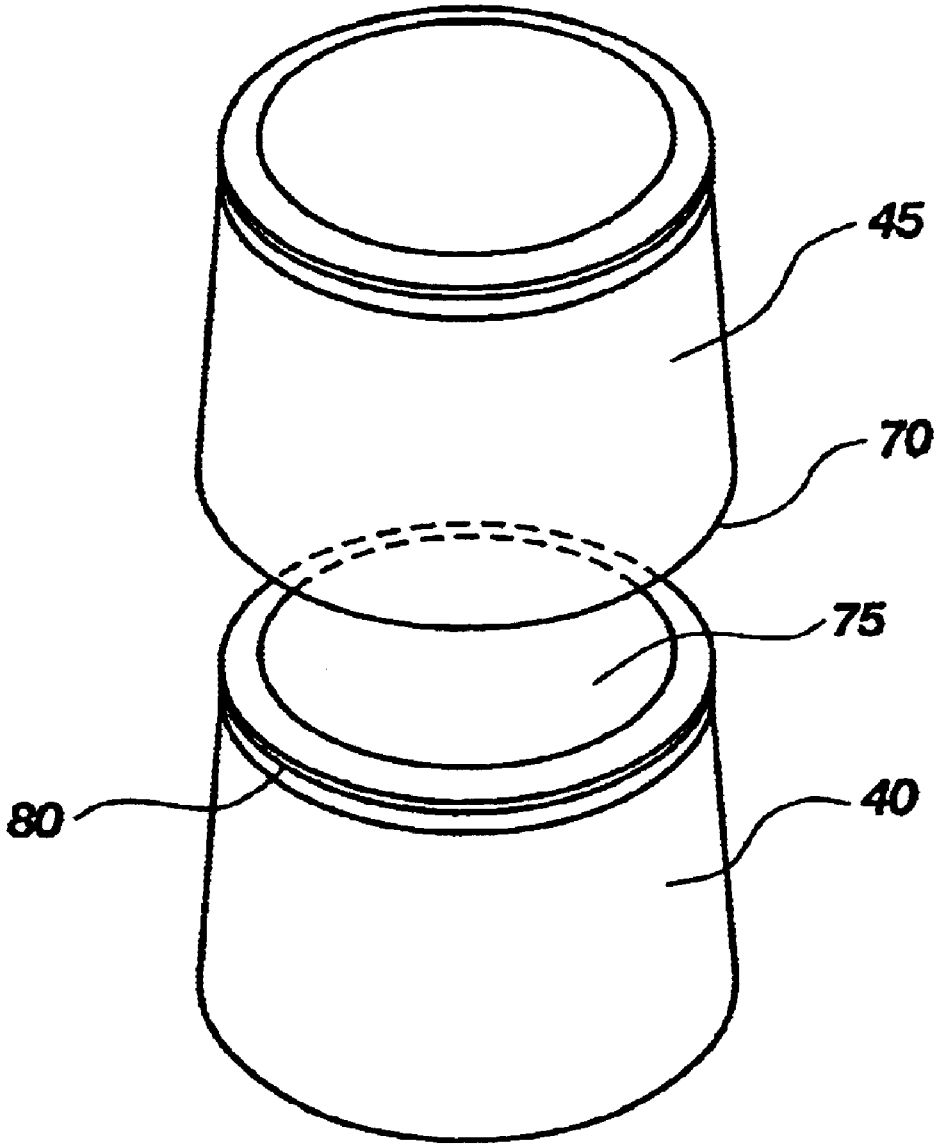
FIG. 2 is a partially exploded perspective view of a nesting portion of a preferred embodiment of the invention.
Figure 3A:
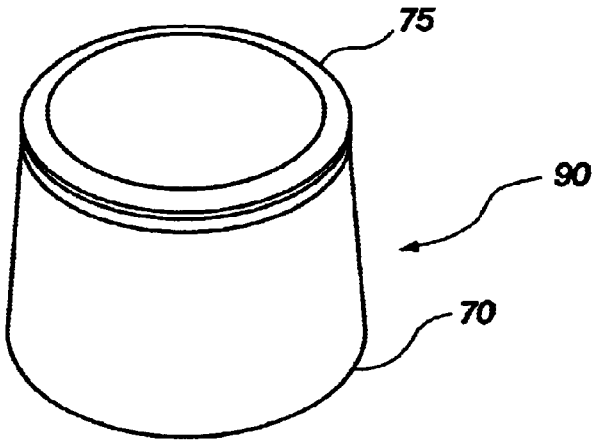
FIG. 3*a* illustrates a perspective view of one piece of the nesting portion of a preferred embodiment of the invention.
Figure 3B:
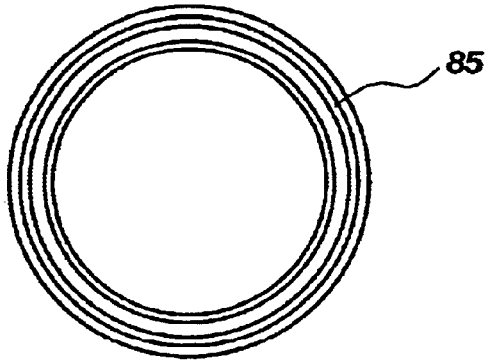
FIG. 3*b* sets forth a bottom view of one piece of the nesting portion of a preferred embodiment of the invention.
Figure 3C:
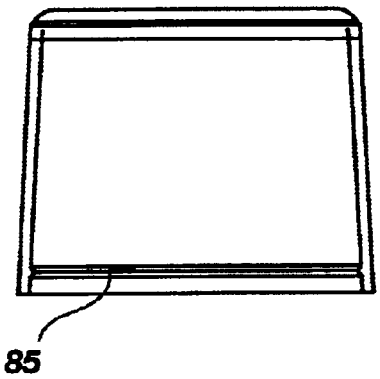
FIG. 3*c* presents a cross-sectional side view of a partially assembled embodiment of the invention.

As more clearly depicted in FIG. 2, the compartment 45 in one presently preferred embodiment is formed in part by associating the bottom end 70 of the compartment 45 with the top end 75 of the cap 40.

One presently preferred embodiment, illustrated in FIG. 2 and FIGS. 3*a*–3*c*, comprises a top end 75 formed with a smaller diameter than the diameter of the bottom end 70, and involves a press-fit nesting of the bottom end 70 to the top end 75 to fully establish and enclose the compartment 45. An exterior annular lip 80 may further be formed around the top end 75 of the cap 40 to enhance the fluid-tight seal initiated by the nesting of the compartment 45 and cap 40, and further to enhance the anchor of the compartment 45 to the cap 40 against inadvertent displacement from each other. A further refinement comprises an interior annular lip 85, illustrated in FIGS. 3*b* and 3*c*, within the compartment 45 at the bottom end 70 to accomplish the same functions as those described for the exterior annular lip 80.

It will be appreciated by one skilled in the art that one and the same mold may be used to form an identical part 90 that may be interchanged as either the cap 40 or the compartment 45, achieving further economy in the manufacture and assembly.

In addition to a nesting relationship, the bottom end 70 and top end 75 of the compartment 45 may be associated by any of several alternative means, such as with a hinge (not shown), a threadable connection (not shown) or an essentially permanent annular attachment with which a sliding wall could be formed adjacent a side of the compartment to selectively slide over to cover or away from to open an access hole to the interior of the compartment (not shown).

Figure 4:
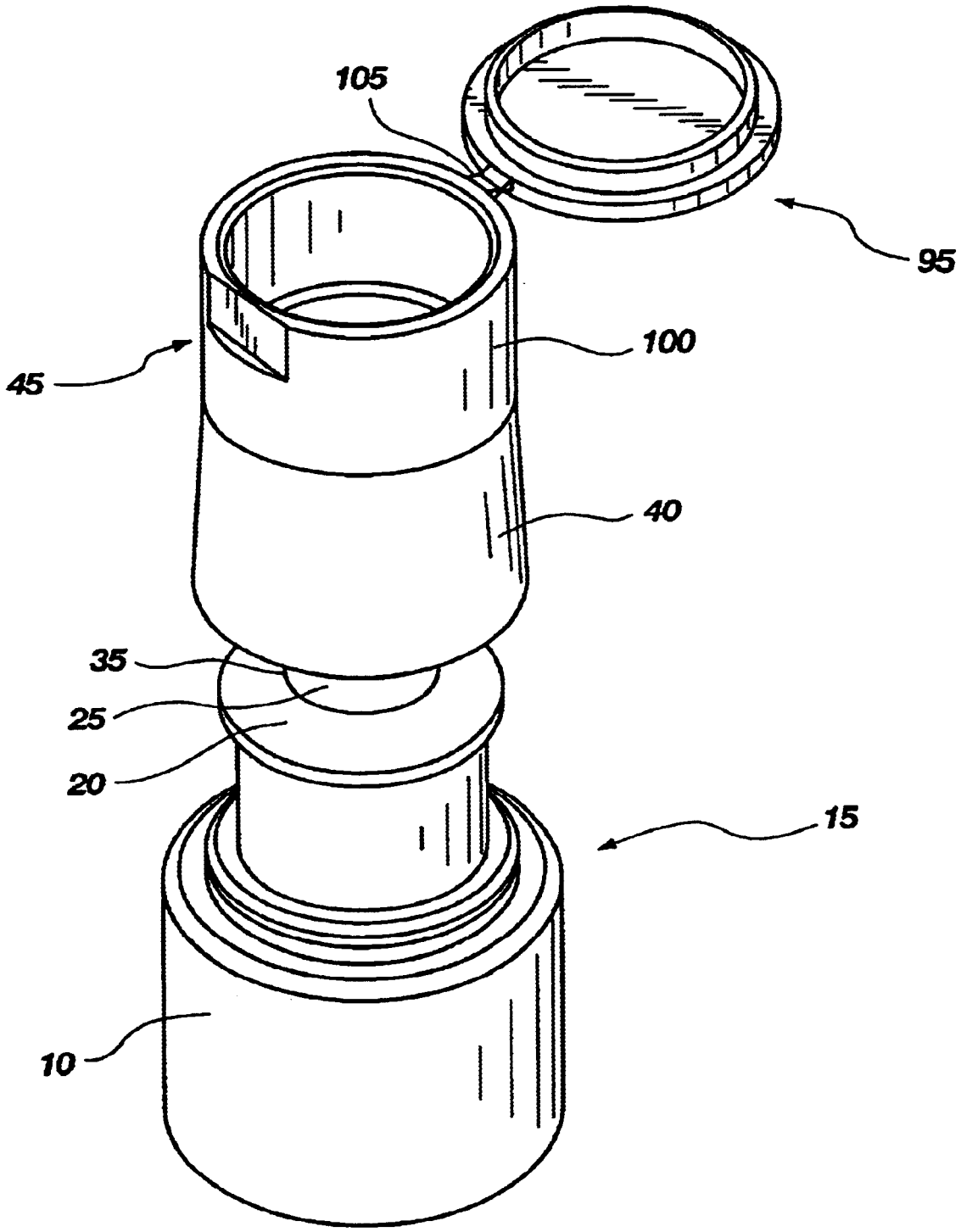
FIG. 4 depicts a partially exploded side perspective view of a first alternative embodiment of the compartment, cap and closure.
Figure 5A:
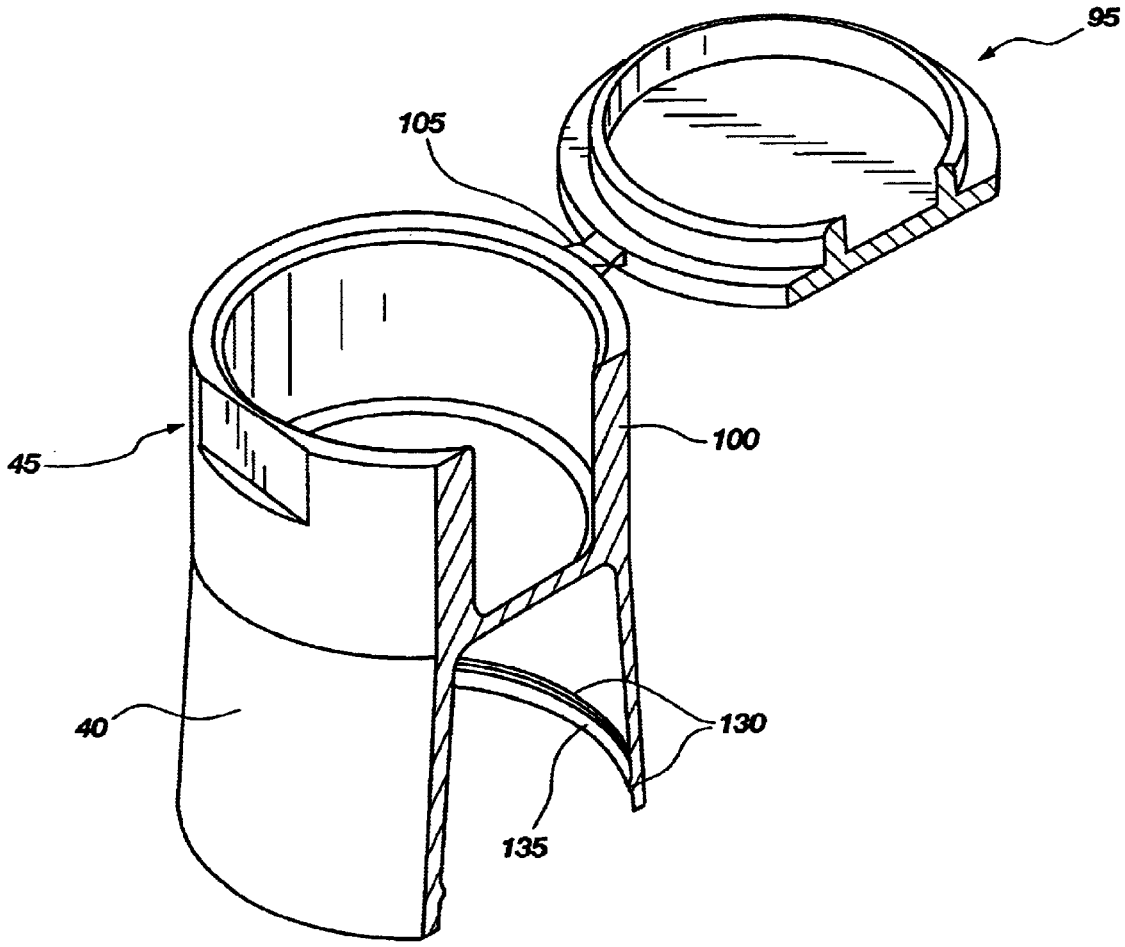
FIG. 5*a* shows a cut away side perspective view of the first alternative embodiment of the compartment and a cap with a rim or press-fit means of attaching to the closure.
Figure 5B:
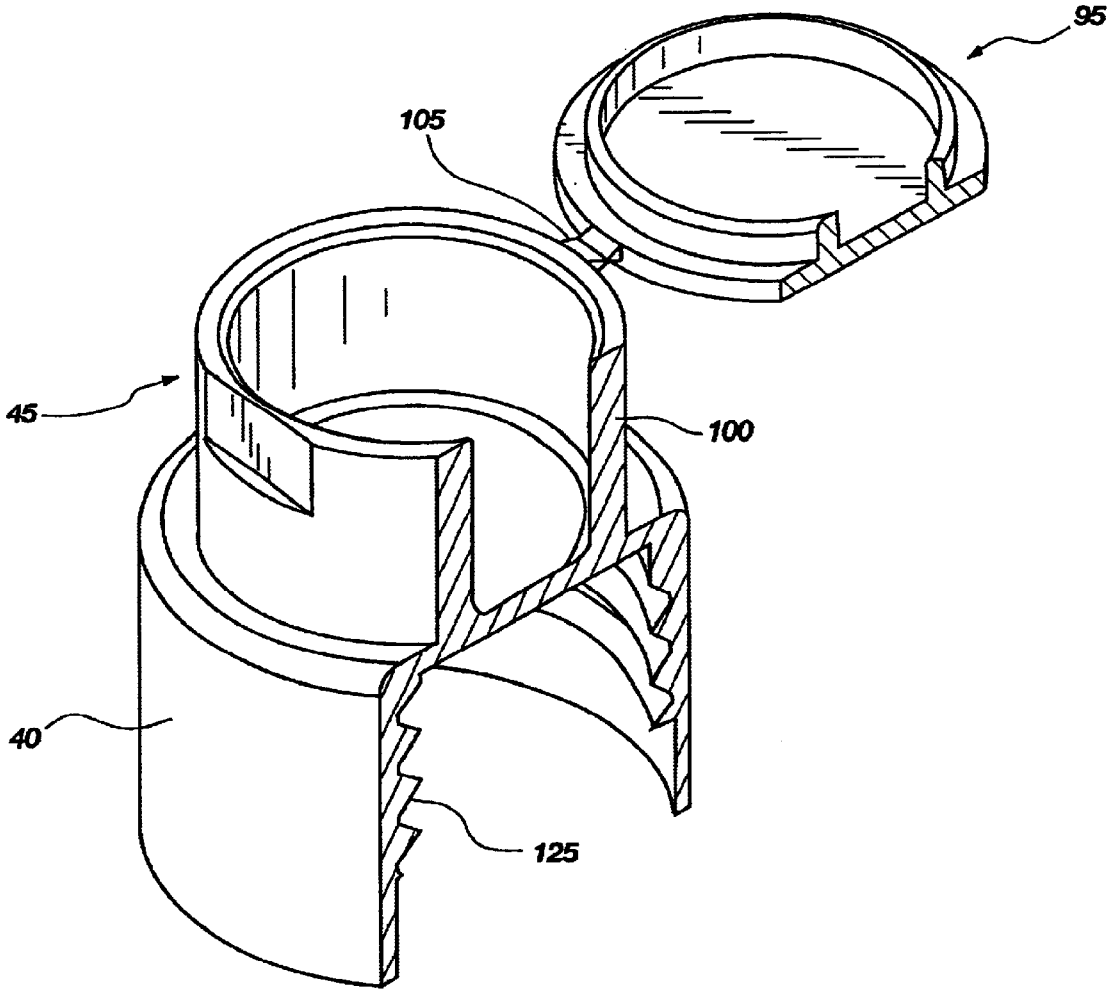
FIG. 5*b* shows a cut away side perspective view of the first alternative embodiment of the compartment and a cap with threaded means of attaching to the closure.
Figure 6A:
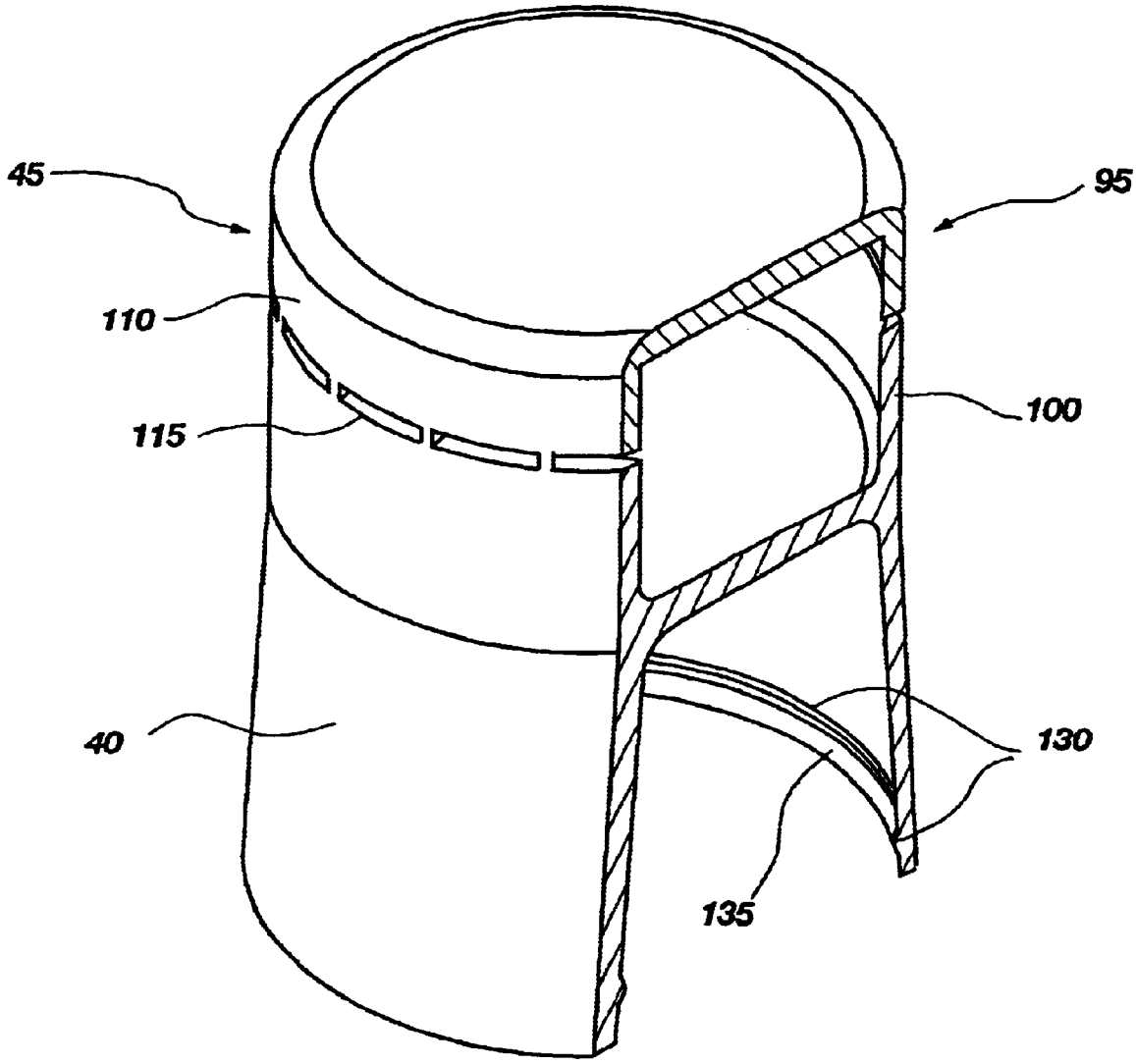
FIG. 6*a* presents a cut away side perspective view of a second alternative embodiment of the compartment and a cap with a rim or press-fit means of attaching to the closure.
Figure 6B:
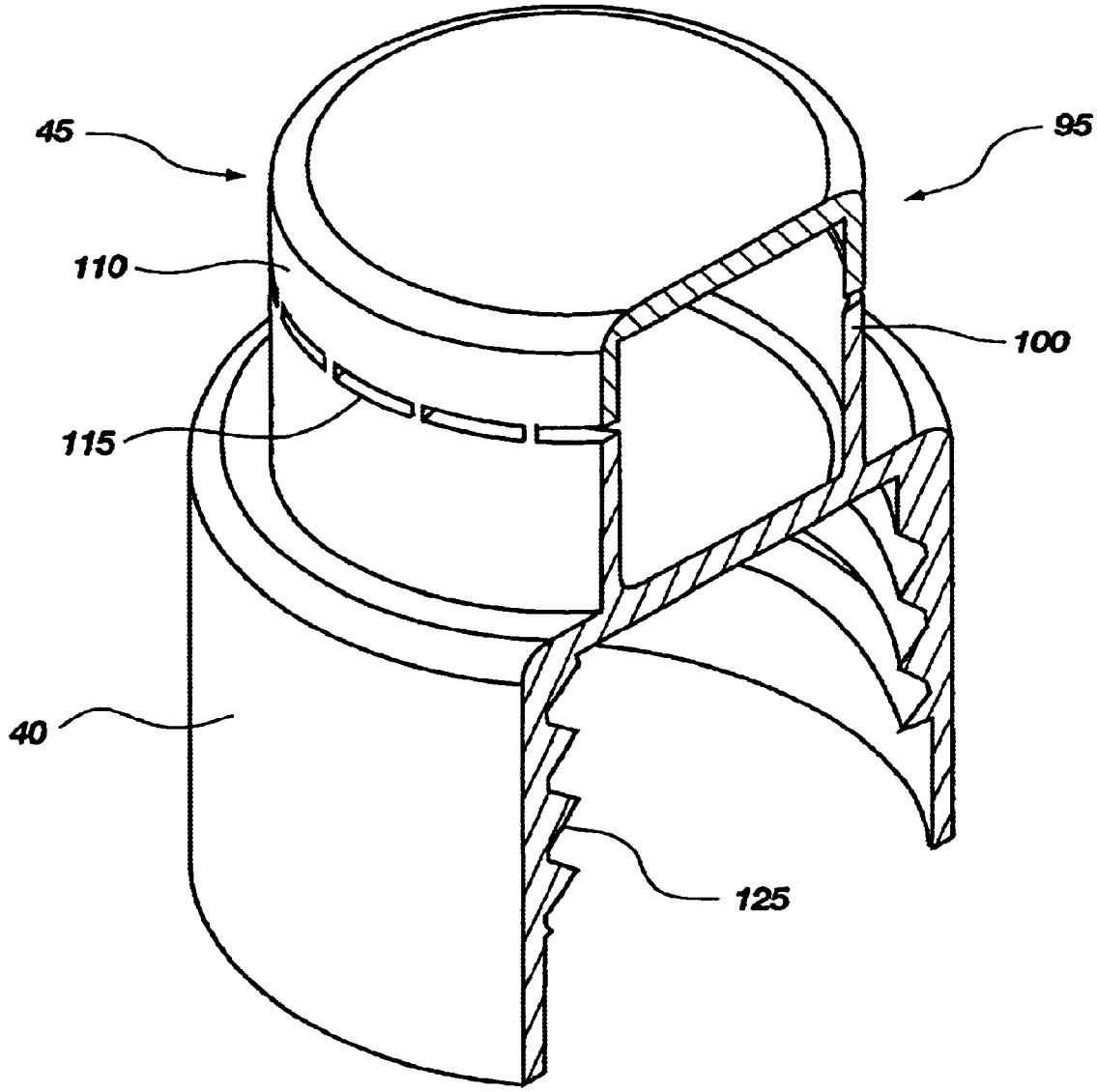
FIG. 6*b* presents a cut away side perspective view of the second alternative embodiment of the compartment and a cap with threaded means of attaching to the closure.
Figure 7A:
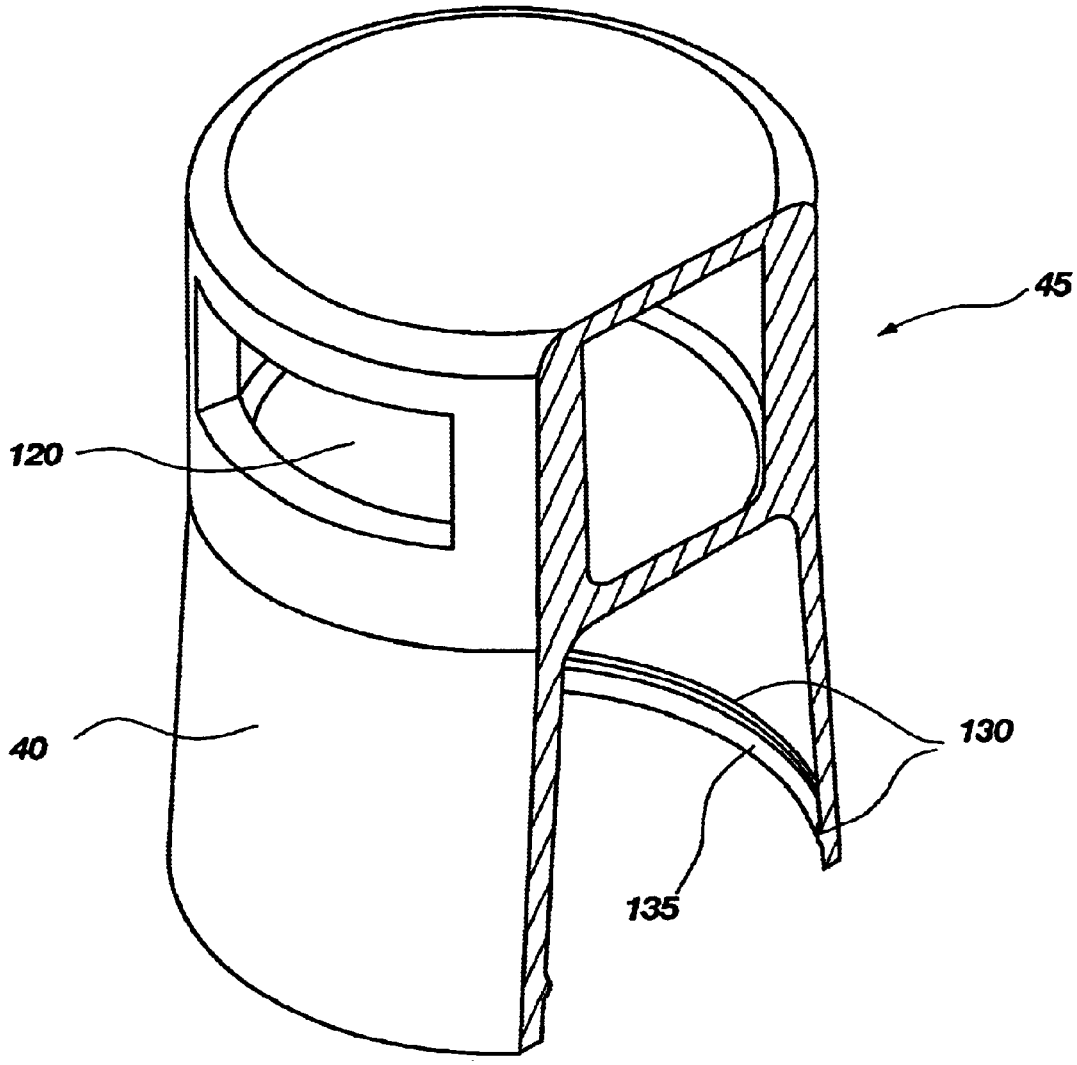
FIG. 7*a* depicts a cut away side perspective view of a third alternative embodiment of the compartment and a cap with a rim or press-fit means of attaching to the closure.
Figure 7B:
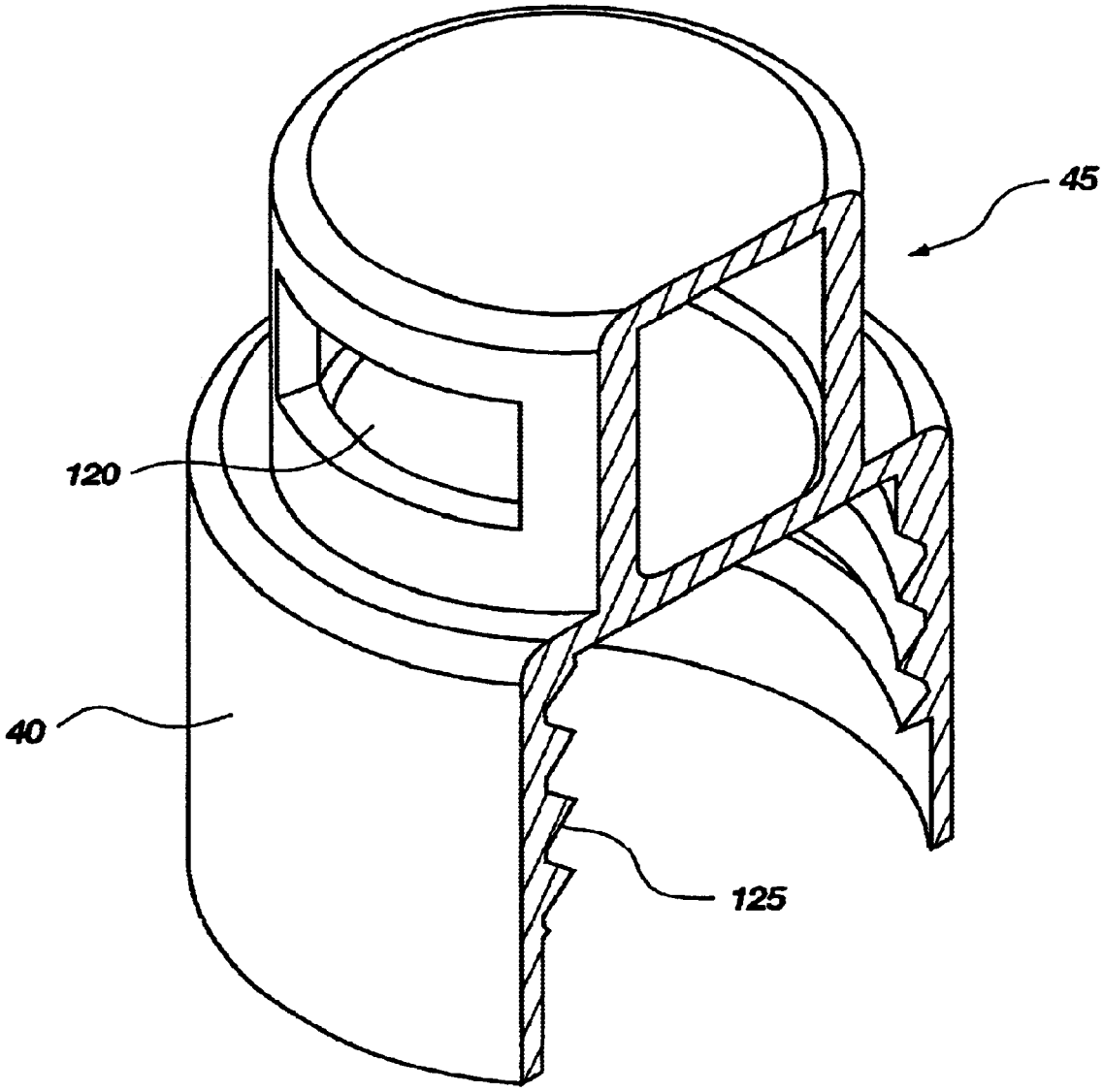
FIG. 7*b* depicts a cut away side perspective view of the third alternative embodiment of the compartment and a cap with threaded means of attaching to the closure.

The compartment 45 may be structured and arranged in any of a variety of commercially appealing configurations to enable access to the supplement 50 stored within the compartment 45. A few such configurations are set forth in FIGS. 4 through 7*b*. A lid 95 may be affixed to the compartment wall 100 by means of a hinge 105, as illustrated in FIGS. 4, 5*a* and 5*b*. Alternately the lid 95 may be configured as a twist top 110 affixed to the compartment wall 100 by means of a perforation 115 susceptible to being torn away, as shown in FIGS. 6*a* and 6*b*. After the twist top 110 is detached along the perforation 115, the lid 95 may remain attached to the compartment 45 by a hinge (not shown). FIGS. 7*a* and 7*b* depict a window access 120 to the compartment 45. In these configurations, the compartment 45 may be enclosed by a shrink wrap (not shown), a rotating wall with a hole (not shown) that slides into registration with the window access 120 or out of registration to enclose the window access 120. Threads 125, rims 130 or press-fit surfaces 135 suggest a few of a variety of means of attaching the cap 40 to the closure 10.

It will be further appreciated by one of skill in the art that any of a wide variety of forms and substances may comprise the supplement 50 and liquid or beverage 30. For example, the enzyme papain is normally stored in a dormant powdered form to be activated by combination with water in a hydrous composition for optimal debriding effect on necrotic proteinaceous tissue. By storing a powdered form of papain supplement in the compartment for combination with water stored in the container for application to, for example, a wound site to achieve immediate and optimally active debridement, the present invention may realize further bodily benefits of a medical nature hitherto unachieved.

The device system of the present invention provides distinct advantages over prior supplement compartments associated with beverage containment systems and methods. Thus, reference herein to specific details of the illustrated or other preferred embodiments is by way of example and not intended to limit the scope of the appended claims. It will be apparent to those skilled in the art that many modifications of the basic illustrated embodiments may be made without departing from the spirit and scope of the invention as recited by the claims.

What is claimed is:

1. A compartment releasably affixed substantially exterior to a dust cap of a beverage container, said compartment structured and arranged to protectively and accessibly enclose a first substance and to enable association of said first substance with a second substance, said second substance being accessibly contained within said beverage container, said association being for substantially combined use with said second substance.

2. The apparatus of claim 1, wherein said compartment is structured and arranged to accommodate selective access to said first substance enclosed therein and selective reclosure of said compartment.

3. The apparatus of claim 1, wherein said compartment and said dust cap are structured and arranged to be interchangeable such that said dust cap can operate as a compartment and said compartment can operate as a dust cap.

4. The apparatus of claim 3, wherein said compartment comprises:

an open end and a closed end;

said open end carrying a retaining structure; and said closed end carrying a receiving structure adapted for releasable engagement with said retaining structure;

wherein a storage volume for said first substance is defined within a first compartment that is attached in engagement to a second compartment operable as said dust cap.

5. The apparatus of claim 4, wherein said retaining structure comprises an interior annular lip and said receiving structure comprises an exterior annular lip.

6. A compartment structured and arranged for temporary enclosure and selective disbursement of an edible supplement that is to be ingested substantially at the same time as and with a beverage dispensed from a container with which said compartment is physically associated, wherein:

said compartment defines a first volume and carries a detachable structure operable as a dust cap capable of protecting a discharge orifice of said container in a nesting arrangement, and said detachable structure of said dust cap defines a second volume.

7. The compartment of claim 6, wherein said dust cap is operable to close said container to resist fluid discharge therefrom.

8. The compartment of claim 6, further comprising a window opening directed exterior to said container whereby to provide access to an interior of said compartment.

9. The compartment of claim 8, further comprising a hinged lid operable to open and close said window.

10. The compartment of claim 8, further comprising a twist-off lid operable to open and close said window.

11.The compartment of claim 8, further comprising a sliding wall operable to open and close said window.

12. The compartment of claim 8, further comprising a shrink wrap operable to cover said window.

13. The compartment of claim 6, wherein said compartment and said dust cap are structured and arranged to be interchangeable such that said dust cap can operate as a compartment and said compartment can operate as a dust cap.

14. The compartment of claim 13, further comprising:

an open end and a closed end, said open end carrying a retaining structure comprising an interior annular lip, said closed end carrying a receiving structure comprising an exterior annular lip adapted for releasable engagement with said retaining structure.

15. A method of securely but temporarily associating an ingestible supplement with a liquid beverage container, comprising:

providing an ingestible supplement within a compartment, said compartment carrying a detachable structure operable as a dust cap;

providing a liquid within a container; and physically associating said supplement and said compartment with said liquid and said container by placing said dust cap into nesting arrangement over a discharge orifice of said container;

wherein said compartment is susceptible to the facile receiving, storing and dispensing of said supplement;

wherein said supplement is readily accessible and retrievable from said compartment for use with said liquid;

whereby said supplement is ingestible concurrently or alternatingly with the imbibing of said liquid within said container.

16. The method of claim 15, wherein said compartment is structured and arranged to nest atop a cap of substantially identical form, dimension and material.

17. The method of claim 16, wherein a physical association of said cap with said container comprises nesting of said cap atop a dispenser end of said container.

18. A dispensing system, comprising:

a vitamin, nutritional, mineral or medicinal supplement;

a compartment for temporary storage of said vitamin, nutritional, mineral or medicinal supplement, said compartment carrying a detachable structure comprising a dust cap;

a beverage comprising water; and a container for temporary accessible storage of said beverage, said container comprising a discharge orifice received inside said dust cap;

wherein said compartment is structured and arranged to accommodate selective access to said vitamin, nutritional, mineral or medicinal supplement stored therein and selective reclosure of said compartment;

wherein said access and reclosure permits imbibing of said beverage concurrent or alternatingly with ingestion or imbibing of said vitamin, nutritional, mineral or medicinal supplement.

* * * * *